US007976006B2

(12) United States Patent
Frisque

(10) Patent No.: US 7,976,006 B2
(45) Date of Patent: Jul. 12, 2011

(54) CONTINUOUS FEED REMOTE CONTROL FOR SLOW SPEED PAPER MOTION

(75) Inventor: Thibault J. G. E. Frisque, Bierges (BE)

(73) Assignee: Xerox Corporation, Norwalk, CT (US)

( * ) Notice: Subject to any disclaimer, the term of this patent is extended or adjusted under 35 U.S.C. 154(b) by 130 days.

(21) Appl. No.: 12/366,031

(22) Filed: Feb. 5, 2009

(65) Prior Publication Data

US 2010/0194028 A1 Aug. 5, 2010

(51) Int. Cl.
*B65H 5/00* (2006.01)
*B65H 5/22* (2006.01)

(52) U.S. Cl. ..... 271/3.14; 271/4.01; 271/8.1

(58) Field of Classification Search ..... 271/3.14, 271/4.01, 8.1
See application file for complete search history.

(56) References Cited

U.S. PATENT DOCUMENTS

| | | | | |
|---|---|---|---|---|
| 6,498,567 | B1 | 12/2002 | Grefenstette et al. | |
| 6,786,149 | B1 * | 9/2004 | Lomoine et al. | 101/223 |
| 7,040,820 | B2 * | 5/2006 | Perdu et al. | 400/76 |
| 2003/0048472 | A1 * | 3/2003 | Perdu et al. | 358/1.15 |
| 2007/0146474 | A1 * | 6/2007 | Kameda et al. | 347/262 |

FOREIGN PATENT DOCUMENTS

| | | | |
|---|---|---|---|
| EP | 0 878 303 | A2 | 11/1998 |
| EP | 1 184 733 | A2 | 3/2002 |
| EP | 1 293 353 | A2 | 3/2003 |
| EP | 1 464 506 | A2 | 10/2004 |

OTHER PUBLICATIONS

European Search Report of European Patent Application No. 10152237.3 mailed Jun. 4, 2010.

* cited by examiner

*Primary Examiner* — David H Bollinger
(74) *Attorney, Agent, or Firm* — Fay Sharpe LLP

(57) ABSTRACT

Systems and methods are described that facilitate remotely controlling paper feed-forward mechanisms on multiple printers in a continuous feed print line, to reduce operator movement during simplex and/or duplex printing and increase print line throughput. The remote control detects a print line (e.g., by user input, a beacon signal provided by the print line, or by some other means), and retrieves IP addresses for printers in the detected print line. A display is provided by which the user selects an identified printer to control, and by which the user then activates and/or deactivates the feed-forward mechanism on the selected printer. Optionally, the remote control functionality is provided as a software package installed on a personal digital assistant (PDA) or smartphone.

14 Claims, 4 Drawing Sheets

CONTINUOUS FEED REMOTE CONTROL FOR SLOW SPEED PAPER MOTION

BACKGROUND

The subject application relates to multiple-printer remote control. While the systems and methods described herein relate to remote control of multiple printing devices in a print line, it will be appreciated that the described techniques may find application in other printing systems, other manufacturing applications, and/or other manufacturing methods.

A continuous feed print line is spread over several feet. Operators have to walk along the line to load the paper or operate the line. When loading the paper or adjusting the paper path, the operator has to stay in front of the printer to move the paper. Operators have difficulty moving the paper along a continuous feed print line.

Continuous feed systems often have two printers to print duplex jobs, and include with pre- and post-processing components. A typical line can be spread over several tens of feet. For instance, an inline duplex print line is approximately 50 feet long. When the operator has to load the paper along the line, the paper must be fed in by a feeding component or hopper while loading it. Different components of continuous feed printers operate at different speeds. When printing speed is referred to as "high speed", it may be approximately 300 ft./min. The loading or feed-forward speed is often called "slow speed," and may be approximately 15 ft./min.

To load the paper into a conventional print line, an operator loads a pre-processing device, such as a hopper or bin, to bring the paper to the input of the upstream or first printer. To load the upstream or first printer, a pre-processor automatically feeds the paper from the first printer to the second printer. The operator must press a "forward" or "on" button on the upstream printer to output sufficient paper amounts (e.g., several meters) in order to load the paper buffer of a downstream or second printer. Between the first and second printers. The operator then has to load the expelled paper from the upstream printer into the downstream printer, and then forward the paper on both printers to load the post processing equipment (e.g., loops, cutter, rewinder, binder, etc.). With each action, there is the option to use the forward buttons on the printer or on a graphical user interface (GUI) coupled to each printer. The forward button on the printer has a local effect, while forward button on the GUI can have a global effect. Both GUIs (e.g., on the first and second printers) allow the operator to feed-forward the paper of the printer to which the GUI is coupled, the other printer in the print line, or both. However, the operator has to be physically in front of the GUI to control paper motion in a conventional print line system, which requires a substantial amount of walking back and forth between the GUI and the loading points.

Another drawback of conventional print line systems is that when the operator forwards the paper, it is expelled from the printer onto the floor. Often, for instance with light-weight paper, the operator has to manually pull the paper while moving it forward to avoid paper stack up (e.g., the paper folding over on itself, etc.) and possible paper damage. In many cases, it is physically impossible for a single operator to press the forward button and pull the paper at the same time.

Another problem arises during loading of the post processing device, where conventional systems require that paper be forwarded from the first printer (e.g., onto the floor), before it can be loaded into the next printer. There is no mechanism for moving the paper of both printers from the post processor location. To adjust some paper guides on paper buffers (e.g., dancing rollers, turn bars, etc.), the paper must be manually fed forward.

In other systems, paper in motion will stabilize itself and paper guides may be set, but an operator cannot feed the paper and remain in front of the buffer at the same time. Rather, one person must activate paper motion while another sets the buffer guides Accordingly, there is an unmet need for systems and/or methods that facilitate remote control of paper feeds on multiple printers in a print line to facilitate single-operator control thereof, while overcoming the aforementioned deficiencies.

BRIEF DESCRIPTION

In accordance with various aspects described herein, systems and methods are described that facilitate remote control of feed-forward functionality in printers in a print line. For example, a method of remotely controlling paper feed for a plurality of printers in a continuous-feed print line comprises detecting a print line to be controlled, identifying printers in the print line to be controlled, and receiving user input related to a printer selected for remote control. The method further comprises receiving user input related to a paper feed-forward command, and transmitting the paper feed-forward command to the selected printer to cause the selected printer to feed paper forward.

According to another feature described herein, a system that facilitates remotely controlling paper feed in a plurality of printers in a continuous-feed print line comprises a print line comprising a plurality of printers, and a remote control that controls a paper feed-forward function of each printer. The system further comprises a print line bus (PLB) that communicates with the remote control, the plurality of printers, a pre-processing component, and a post-processing component.

Yet another feature relates to a remote control device that controls a paper feed-forward function in a plurality of printers in a continuous feed print line. The remote control device comprises a receiver that receives information related to the plurality of printers from the PLB, and a transmitter that transmits information related to the plurality of printers to the PLB. The remote control further comprises a memory that stores printer identity information for the plurality of printer, a processor that detects the presence of the print line upon receiving a beacon signal from the print line and performs a table lookup to identify the plurality of printers in the print line, and a display that displays printer information to an operator.

DETAILED DESCRIPTION

In accordance with various features described herein, systems and methods are described that facilitate remotely instructing multiple printers to feed paper, eliminate a need for an operator's physical presence at the paper feed point. A remote control permits the operator to remotely activate slow speed paper motion of a continuous-feed or continuous web print line print line. The remote control may be wired or wireless, and may operate from anywhere along the print line, in the same room as the print line, or remotely therefrom.

The described innovation eliminates a need for an operator to manually feed paper into a printer in a print line, and then walk over to a feed-forward controller to initiate paper movement. In other aspects, the described innovation eliminates a need for a second operator to operate a print line.

Figure 1:
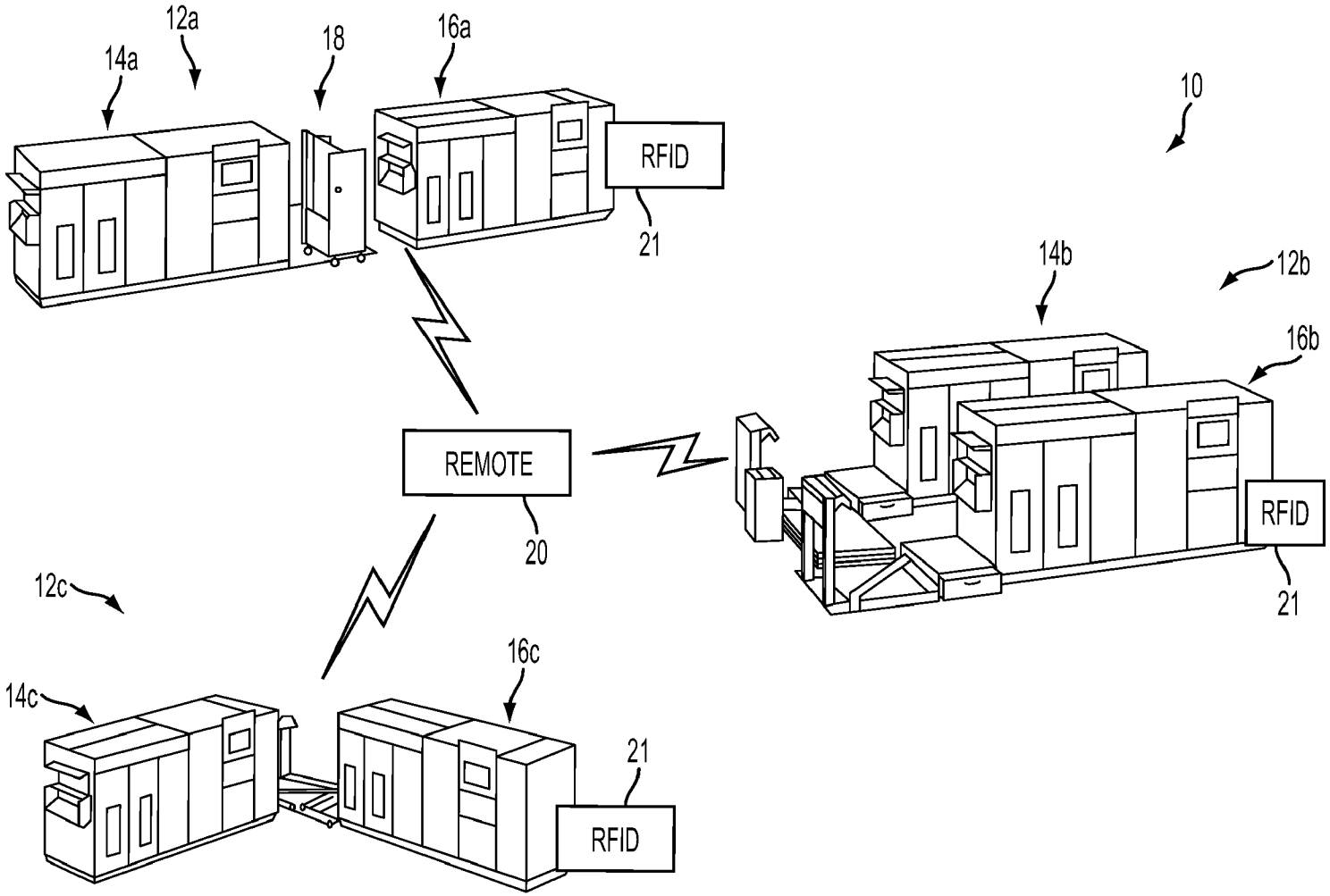
FIG. 1 illustrates a remote-control print line system comprising one or more duplex continuous feed print lines shown in the three most common configurations, which may be remotely operated in accordance with various aspects described herein.

With reference to FIG. 1, a remote-control print line system 10 comprising one or more duplex continuous feed print lines 12 is illustrated, with print lines shown in the three most common configurations, which may be remotely operated in accordance with various aspects described herein. It will be appreciated that the remote-operation print line systems and methods described herein are not limited to the illustrated configurations, but rather FIG. 1 is provided for illustrative purposes.

The system 10 includes an in-line or tandem duplex print line 12*a*, comprising a first (e.g., upstream) printer 14*a* and a second (e.g., downstream) printer 16*a*. Additionally or alternatively, the system 10 includes a parallel (e.g., side-by-side) print line 12*b*, which comprises a first printer 14*b* and a second printer 16*b*. Moreover, the system 10 may include a 90° (e.g., L-shaped) print line 12*c*, which includes a first printer 14*c* and a second printer 16*c*. The print lines are generally referred to herein by the reference number 12, first or upstream printers by the reference numeral 14, and second or downstream printers by the reference numeral 16, unless specifically referring to an inline, parallel, or 90° print line configuration. Finally, the system includes a remote control, by which an operator remotely controls the print line 12.

To load the paper into the inline print line 12*a*, an operator loads a pre-processing device, such as a hopper or bin (not shown), to bring the paper to the input of the upstream or first printer 14*a*. To load the upstream printer 16*a*, a pre-processor automatically feeds the paper from the first printer 14*a* to the second printer 14*b*. In a conventional system, the operator must press a "forward" or "on" button on the upstream printer 14*a* to put enough paper on the floor in order to load the paper buffer of the upstream printer. Between the first and second printers, there is a turn bar 18 or loop that transfers paper from one device to the other.

The operator then has to load the downstream printer, and then forward the paper on both printers to load the post processing equipment (e.g., loops, cutter, rewinder, binder, . . . ) with each action, there is possibility to use the forward buttons on the printer or on the a graphical user interface (GUI) coupled to each printer. The forward button on the printer has a local effect, while forward button on the GUI can have a global effect. Both GUIs allow the operator to feed the paper of the printer to which the GUI is coupled, the other printer in the print line, or both. However, the operator has to be physically in front of the GUI to control paper motion in a conventional print line system.

In order to overcome the deficiencies noted above with regard to conventional duplex or multiplex print line systems, the system 10 includes a wireless remote control 20 that controls the slow-speed paper motion of a continuous print line. The remote control 20 is able to control one or more printers 14, 16 at the same time. An operator is able to control the slow speed paper motion of all printers from anywhere in the print line, such as at the loader or pre-processing station on a printer.

According to one example, the remote control is an electronic device that uses wireless communication media. Any kind of wireless protocol may be employed, such as radio frequency (RF), wireless universal serial bus (USB), WiFi, Bluetooth™, Zigbee™, infrared (IR), or any other suitable wireless protocol.

According to an example, the remote control 20 identifies one or more print lines 12 by detecting a beacon signal from an RFID tag 21 coupled to the print line. The remote then performs a table lookup to identify printers in the detected print line. In another example, the remote 20 detects print line(s) be receiving a communication transmission signal from the print line(s) 12 and/or printers 14, 16, therein.

Figure 2:
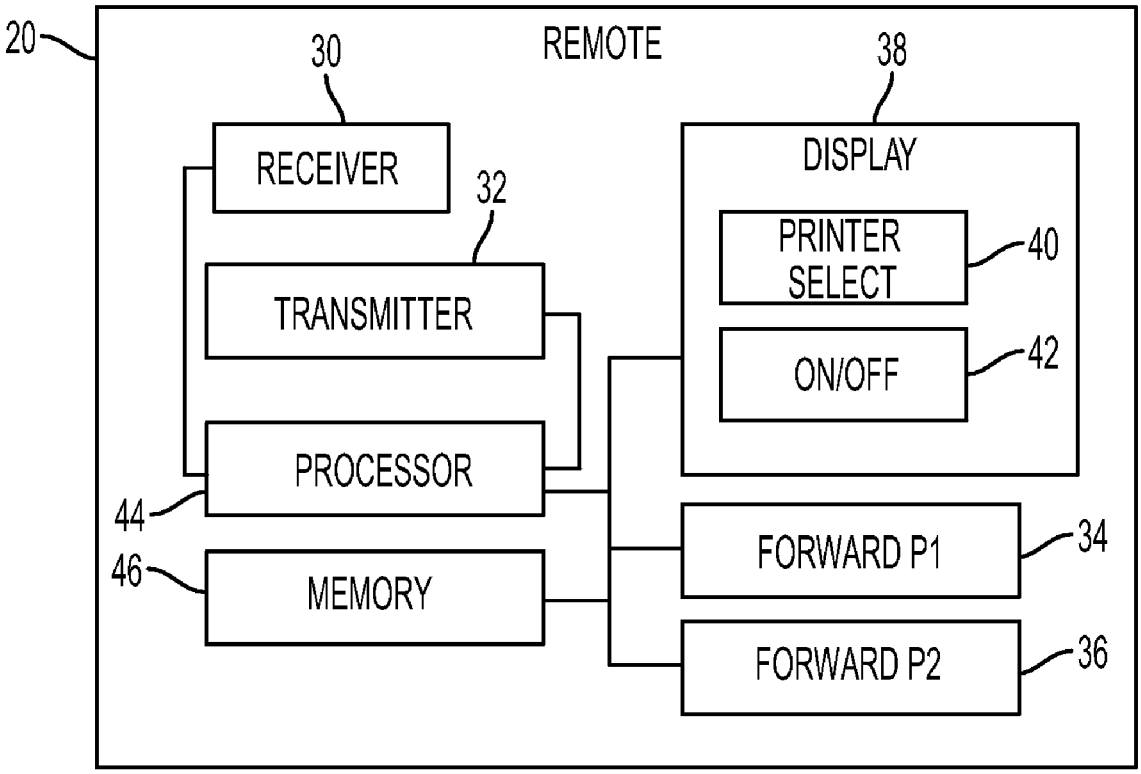
FIG. 2 illustrates the remote control, according to one or more features described herein.

FIG. 2 illustrates the remote control 2 according to one or more features described herein. The remote control 20 includes a receiver 30 that receives information from one or more printers (See FIG. 1) in a print line assembly, and a transmitter 32 that transmits information to the one or more printers. According to one aspect, the receiver and transmitter are combined as a transceiver that performs both receiving and transmitting functions to communicate with the printers.

In one example, the remote 20 is a simple remote with two buttons for each printer in the print line: a FORWARD P1 button 34 to start the paper feeding forward from the upstream printer, and a FORWARD P2 button 36 to start the paper feeding forward from the downstream printer. Paper is fed forward from respective printers while the button is depressed, and stops feeding forward upon release of the button. In another example, the remote includes a single toggle-type button or switch for each printer, where the button or switch has an ON position, at which the remote signals the printer to feed paper forward, and an OFF position, at which paper feeding is stopped.

In the illustrated example, the remote 20 also includes a display 38 (e.g., an LCD display, a touchscreen, or some other suitable display) with a printer selection virtual button or icon 40 that an operator selects (e.g., using a stylus or other input mechanism (e.g., a directional pad, thumbwheel, etc.), and an ON/OFF virtual button or icon 42 that the operator depresses or selects to control paper feed for a selected printer. In a more specific example, the display 38 is a touch screen, and the operator scrolls through and selects a printer for paper feed-forward control and then selects the ON/OFF button or icon 42 to start feeding paper into the selected printer.

The remote control 20 additionally includes a processor 44 that executes, and a memory 46 that stores, computer-executable instructions for carrying out the various functions described herein. For instance, the memory may store a set of computer executable instructions (e.g., a computer software application or the like) that is executed by the processor 44 to select a printer for feed-forward control. Printer identities (e.g., internet protocol (IP) addresses and the like) are stored in the memory 46, and the processor recalls printer-specific communication signal protocols to generate a transmission signal to a selected printer. For instance, selection of a given printer by the operator causes the processor 44 to access a lookup table or the like in the memory 46 to identify the IP address for the selected printer. When the operator depresses or selects the ON/OFF icon 42, the processor 44 instructs the transmitter to transmit an ON command to the selected printer using the identified IP address. Similarly, when the operator desires to stop feeding paper forward, the operator selects the ON/OFF icon a second time to return the feed-forward mechanism on the printer to an OFF state.

In another aspect, the memory stores a most recent status for each printer, such that selection of the ON/OFF icon or button 42 causes a state change in the selected printer (e.g., from ON to OFF when the current status is ON, or from OFF to ON when the current status is OFF).

According to another aspect, the receiver 30 receives continuous or periodic status updates from printers in a given print line and/or in a given room or printing area. The operator may select a first printer and activate (or deactivate) the paper feed-forward function therein, then select a second printer, cause a state change of the feed-forward mechanism thereat, and then re-select the first printer to deactivate (or activate) the paper feed-forward function therein. In this manner, the operator can control all printers and/or print lines in a predefined area (e.g., a room) using the single remote control 20.

In another example, the remote control 20 is a software application stored in a personal digital assistant (PDA), cell phone, smartphone, laptop, etc., and the memory 46 stores printer identity information for all printers in all print lines in a printing facility. The memory 46 also stores a lookup table that the processor 44 accesses to determine printer identities in a given room or area upon determining that the remote control 20 has entered a room or area with one or more print lines. Such determination may be performed by the processor 44 upon receipt (e.g., by the receiver 30) of a status signal (e.g., of the feed-forward mechanism) from one or more of the printers in the room.

Additionally or alternatively, a global positioning system or RFID tag system may be employed to determine remote control location. In the case of an RF tag system, each room is equipped with an RF tag (e.g., a transmitter), for example positioned near the door or at the center of the room, and the remote control 20 includes an RF receiver that detects the signal transmitted from the RF tag. The processor 44 then performs a table lookup (e.g., of a lookup table in the memory 46) to match the RF tag information to a room, and additionally performs a second table lookup to identify printers and/or print lines associated with the identified room. In another example, the RF tag in the room is directly associated with the one or more printers and/or print lines, such that the processor performs only a single table lookup to identify the printers and/or print lines in the room upon detecting the RF tag. In any case, once the processor 44 has identified the printers in the room, printer identities can be present to the operator on the display 38 for selection and feed-forward control.

In another example, an operator enters a room with one or more print lines therein, and enters room identification information (e.g., a code, number etc.) into the remote control, which may be a PDA or smartphone or the like with a remote control software package installed thereon. Once the remote control receives the room identification information, the processor performs a table lookup to identify printers in the room, retrieves stored IP addresses therefor, and initiates communication therewith for paper feed-forward control.

Figure 3:
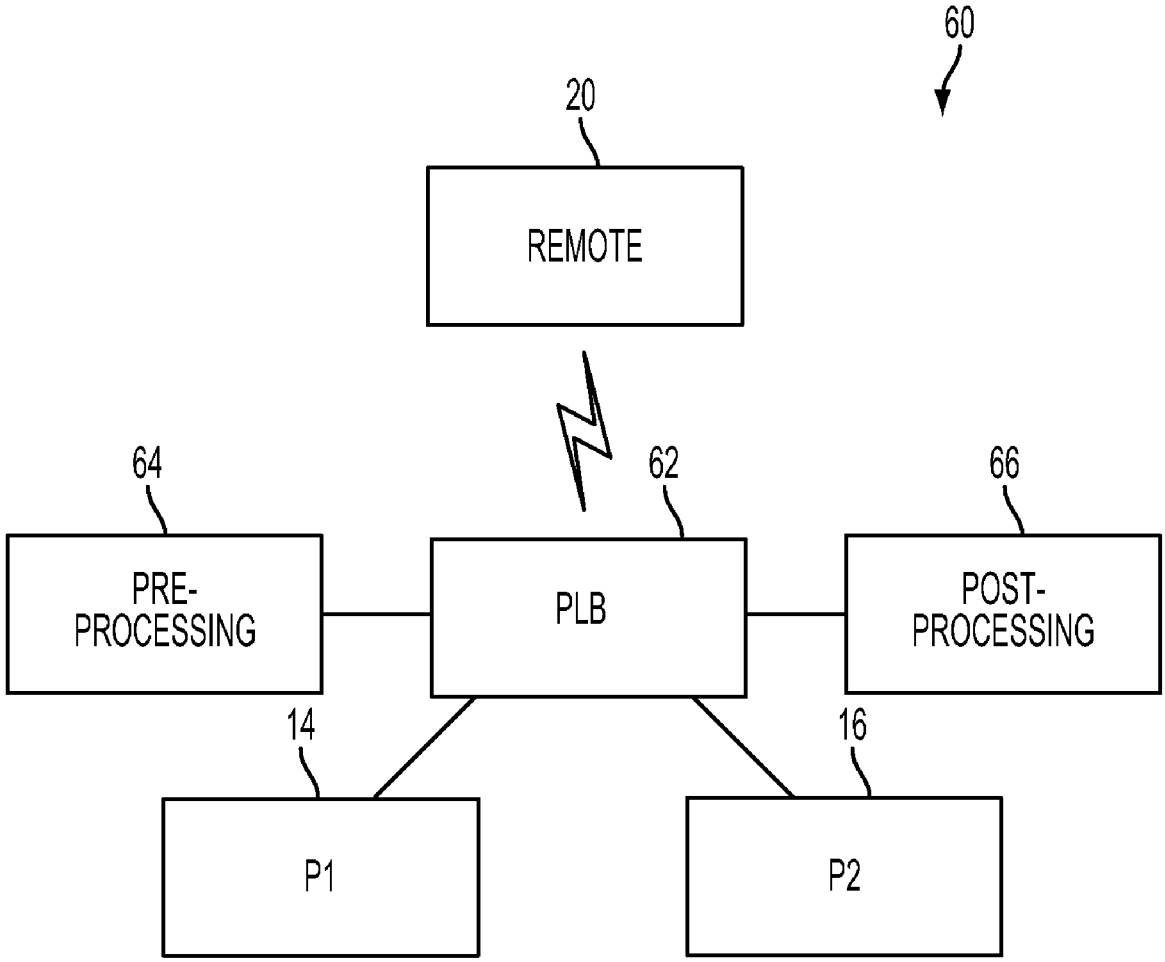
FIG. 3 illustrates a system that includes a print line bus (PLB), in accordance with various aspects described herein.

FIG. 3 illustrates a system 60 that includes a print line bus (PLB) 62, in accordance with various aspects described herein. Printer controllers in the printers 14, 16 communicate with each other via the PLB 62. However, it will be appreciated that the print controllers can employ other communication means, such as CAN, Ethernet, and the like. Accordingly, the wireless remote 20 can be linked to one of these media. In the illustrated example, the remote control 20 communicates with the PLB 62, which relays commands therefrom to the respective (e.g., selected) printers.

The PLB is an "intelligent" box connecting all devices in a print line, and handles all wireless communication from the remote control 20 and instructs print controllers in the printers 14, 16 to move paper via communication media. The printers 14 16 also communicate print line information to the remote control 20 via the PLB 62. In one example, the remote 20 presents print line identity information on its display, and the operator can select from different kind of actions to be performed by the printers.

The system 60 further includes pre-processing components 64 and post-processing components 66, which communicate with each other, with the printers 14, 16, and with the remote control 20 via the PLB 62. Upon entering a new room or otherwise entering a predetermined proximity to a print line, the remote control 20 requests configuration information from the PLB 62, which then transmits printer identification information and the like. In another example, the PLB 62 detects the remote control (e.g., via an RF signal or the like transmitted therefrom), and automatically transmits configuration information thereto.

In this manner, a single operator can enter a room, view print line status for printers therein, and take appropriate action. For instance, the user may be presented with an alert (e.g., on the display of the remote) indicating that the paper needs to be fed forward from a post-processing component 66 of a first printer 14, in order to be threaded into the pre-processing component 64 of a second printer 16. The operator can then move to the post-processing component 66, initiate paper feed-forward in the first printer 14 via the remote, manually guide the paper if necessary to prevent fold-back or other problems, thread the fed-forward paper into the second printer, and continue printing. The operator can achieve all of this from one location along the print line, without having to feed paper forward from the first printer, walk 20 feet to thread the paper into the second printer, walk another 20 feet return to the feed-forward controls, etc. In this manner, the system 60 facilitates enabling a single operator to control a print line.

Figure 4:
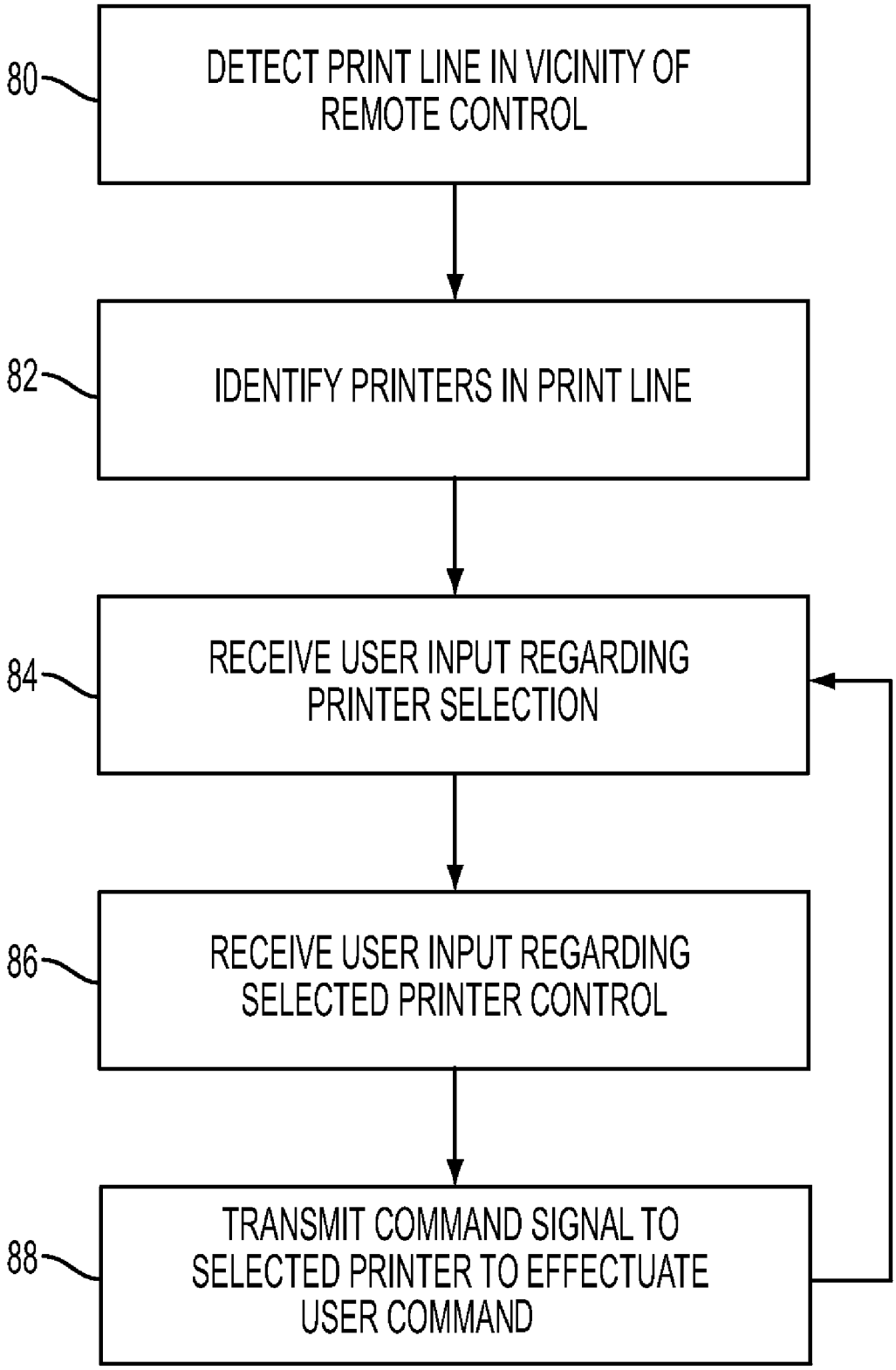
FIG. 4 illustrates a method of controlling a continuous feed duplex print line from a single location via remote control, in accordance with various aspects described herein.

FIG. 4 illustrates a method of controlling a continuous feed duplex print line from a single location via remote control, in accordance with various aspects described herein. At 80, a print line in the vicinity of the remote control is detected and/or identified. Such identification can occur via detection by the remote control of an RF signal transmitted by a component of the print line or by an RF transmitter or tag located at or near the print line. In another example, the print line monitors its vicinity, detects the presence of the remote control, and transmits identity information.

At 82, printer identity is determined by the remote control. Printer identity may be determined from information received from one or more printers in the print line. IN another example, printer identity is determined via a table lookup one the remote control has identified the print line in its vicinity. For instance, the remote control can access a lookup table to retrieve printer information for printers in the identified print line.

At 84, the remote control receives user input related to a selected printer, which the user has selected based on printers identified in the print line and presented to the user on a display of the remote control.

At 86, the remote control receives printer control information entered by the user (e.g., by selection the ON/OFF icon of FIG. 2 or the like).

At 88, the remote control transmits a command signal to the selected printer to execute the desired command. The printer then executes the command, and the method reverts to 84 to await further user input.

According to an example, the method is stored to a memory as a set of computer-executable instructions (e.g., a software application or package) that is executed by one or more processors in a device such as a PDA or smartphone. The device identifies itself to a print line manager (e.g., a computing system onboard the print line) and request printer IP addresses for communication control signals related to control of the paper feed-forward mechanisms on each printer. In another example, the PDA has pre-stored IP addresses for all printers in all print lines in a print facility, and perform a table lookup to identify printers in a given room or area upon identification of print lines therein. Print line identification is performed as a function of a received beacon signal from a nearby print line, or as a function of user input identifying the room or area and a table lookup that provides printer ID information that is cross-reference to the room or area.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system that facilitates remotely controlling paper feed in a plurality of printers in a continuous-feed print line, comprising:

a print line comprising a plurality of printers;

a remote control that controls a paper feed-forward function of each printer; and a print line bus (PLB) that communicates with the remote control, the plurality of printers, a pre-processing component, and a post-processing component;

wherein the remote control communicates with the PLB using a wireless communication protocol comprising one or more of:

a radio frequency (RF) communication protocol;

a WiFi communication protocol;

a short-range wireless-communication protocol;

a wireless universal serial bus (USB) communication protocol; and an infrared (IR) communication protocol.

2. The system of claim 1, wherein the remote control comprises:

a receiver that receives information related to the plurality of printers from the PLB;

a transmitter that transmits information related to the plurality of printers to the PLB;

a memory that stores printer identity information for the plurality of printers;

a processor that detects the presence of the print line upon entry of the remote control into a predefined radius of the print line, and performs a table lookup to identify the plurality of printers in the print line; and a display that displays printer information to an operator.

3. The system of claim 2, wherein the display is a touch screen display.

4. The system of claim 3, wherein the touch screen display permits the operator to select a printer on the touch screen display for controlling via the remote control.

5. The system of claim 4, wherein the display further comprises an ON/OFF icon that is selectable by the operator to activate and deactivate a paper feed-forward mechanism in the selected printer.

6. The system of claim 2, wherein the remote control is implemented as a software package on at least one of a personal digital assistant (PDA), a smartphone, a cellular phone, and a laptop.

7. The system of claim 2, wherein the processor detects the presence of the print line upon receiving a beacon signal from the print line.

8. The system of claim 7, wherein the beacon signal is a radio frequency (RF) signal generated by an RF identification (RFID) tag on the print line.

9. The system of claim 1, further comprising a touchscreen display that displays printer information to an operator.

10. The system of claim 9, wherein the display permits the operator to select a printer on the touchscreen display for controlling via the remote control.

11. The system of claim 10, wherein the display further comprises an ON/OFF icon that is selectable by the operator to activate and deactivate the paper feed-forward mechanism in the selected printer.

12. The system of claim 11, wherein the remote control is implemented as a software package on at least one of a personal digital assistant (PDA), a smartphone, a cellular phone, and a laptop.

13. The system of claim 1, further comprising a touchscreen display with an ON/OFF icon that is selectable by an operator to activate and deactivate the paper feed-forward mechanism in a selected printer.

14. The system of claim 1, wherein the remote control is implemented as a software package on at least one of a personal digital assistant (PDA), a smartphone, a cellular phone, and a laptop.

* * * * *